US009915896B2

(12) United States Patent
Oyama et al.

(10) Patent No.: US 9,915,896 B2
(45) Date of Patent: Mar. 13, 2018

(54) IMAGE FORMING APPARATUS

(71) Applicant: Brother Kogyo Kabushiki Kaisha, Nagoya (JP)

(72) Inventors: Yoshihiro Oyama, Tokai (JP); Tomoya Yamamoto, Kasugai (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 15/417,271

(22) Filed: Jan. 27, 2017

(65) Prior Publication Data

US 2017/0227899 A1 Aug. 10, 2017

(30) Foreign Application Priority Data

Feb. 5, 2016 (JP) ..... 2016-020943

(51) Int. Cl.
*G03G 15/20* (2006.01)
*G03G 21/16* (2006.01)
*G03G 15/23* (2006.01)

(52) U.S. Cl.
CPC ..... *G03G 15/2028* (2013.01); *G03G 15/234* (2013.01); *G03G 21/1647* (2013.01); *G03G 21/1685* (2013.01); *G03G 21/1695* (2013.01); *G03G 2215/00438* (2013.01); *G03G 2215/00565* (2013.01); *G03G 2215/00586* (2013.01)

(58) Field of Classification Search
CPC ..... G03G 15/2028; G03G 15/234; G03G 2215/00565
See application file for complete search history.

(56) References Cited

U.S. PATENT DOCUMENTS 4,602,868 A * 7/1986 Tsubo ..... G03G 15/234 355/26
2008/0279601 A1* 11/2008 Sahara ..... B65H 29/12 399/401
2009/0190956 A1* 7/2009 Carter ..... G03G 15/0126 399/167

FOREIGN PATENT DOCUMENTS

JP 2002-003048 A 1/2002
JP 2008-254880 A 10/2008
JP 2012-140201 A 7/2012

* cited by examiner

*Primary Examiner* — Ryan Walsh
(74) *Attorney, Agent, or Firm* — Burr & Brown, PLLC

(57) ABSTRACT

An image forming apparatus includes a photosensitive drum, a fixing unit including a fixing roller, a sheet ejection tray, a switchback roller, a re-feeding roller, a first frame, a second frame, a first motor, a first transmission mechanism, a second motor, and a second transmission mechanism. The switchback roller is configured to rotate in a forward direction to convey a sheet to the tray and in a reverse direction to convey the sheet back toward the photosensitive drum. The first motor and the first transmission mechanism are disposed to the first frame. The first transmission mechanism is configured to transmit the drive force from the first motor to the fixing roller. The second motor and the second transmission mechanism are disposed to the second frame. The second transmission mechanism is includes a clutch mechanism configured to intermittently transmit the drive force from the second motor to the re-feeding roller.

9 Claims, 4 Drawing Sheets

IMAGE FORMING APPARATUS

CROSS-REFERENCE TO RELATED APPLICATION

This application claims priority from Japanese Patent Application No. 2016-020943 filed on Feb. 5, 2016, the content of which is incorporated herein by reference in its entirety.

FIELD OF DISCLOSURE

Aspects disclosed herein relate to an electrophotographic image forming apparatus configured to form images on both sides of a sheet.

BACKGROUND

A known image forming apparatus having a duplex printing function includes an ejection roller, a re-feeding roller, and a fixing roller, which are driven by a common motor. The ejection roller is a switchback roller which is rotatable in both forward direction and reverse direction. The ejection roller is disposed on an opposite side of the fixing unit from the re-feeding roller.

Due to this positional relationship, a transmission mechanism for transmitting a drive force to the fixing unit and a transmission mechanism for transmitting a drive force to the ejection roller are disposed in the vicinity of the motor.

SUMMARY

The above image forming apparatus, however, may necessitate an arrangement avoiding an overlap between the transmission mechanism for transmitting a drive force to the fixing unit and the transmission mechanism for transmitting a drive force to the ejection roller. Thus, the structures of the transmission mechanisms may increase in complexity, which may make it difficult to minimize the need to increase the physical size of the image forming apparatus.

Illustrative aspects of the disclosure provide an image forming apparatus having a duplex printing function, which reduces the need to increase the physical size of the image forming apparatus.

According to an aspect of the disclosure, an image forming apparatus configured to form images on both sides of a sheet, includes a photosensitive drum, a fixing unit, a sheet ejection tray, a switchback roller, a re-feeding roller, a first frame, a second frame, a first motor, a first transmission mechanism, a second motor, and a second transmission mechanism. The photosensitive drum is configured to carry a developer image to be transferred to the sheet. The fixing unit is disposed downstream of the photosensitive drum and configured to fix the developer image on the sheet, the fixing unit including a fixing roller. The sheet ejection tray is configured to receive the sheet having the image fixed by the fixing unit. The switchback roller is configured to rotate in a forward direction to convey the sheet ejected from the fixing unit to the sheet ejection tray in a forward rotation mode and to rotate in a reverse direction to convey the sheet ejected from the fixing unit back toward the photosensitive drum again in a reverse rotation mode. The re-feeding roller is configured to re-feed the sheet fed by the switchback roller toward the photosensitive drum. The first frame is disposed to a first end of the fixing roller in an axial direction of the fixing roller. The second frame is disposed to a second end, opposite to the first end, of the fixing roller in the axial direction. The first motor is disposed to the first frame and configured to generate a drive force. The first transmission mechanism is disposed to the first frame and configured to transmit the drive force generated in the first motor to the fixing roller. The second motor is disposed to the second frame and configured to generate a drive force. The second transmission mechanism is disposed to the second frame and configured to transmit the drive force generated in the second motor to the switchback roller and the re-feeding roller. The second motor is configured to rotate in a forward rotation direction such that the switchback roller enters the forward rotation mode, and to rotate in a reverse rotation direction such that the switchback roller enters the reverse rotation mode. The second transmission mechanism includes a clutch mechanism configured to intermittently transmit the drive force generated in the second motor to the re-feeding roller. The clutch mechanism is configured to, when the second motor rotates in the forward rotation direction, interrupt transmission of the drive force generated in the second motor, and when the second motor rotates in the reverse rotation direction, transmit the drive force generated in the second motor to the re-feeding roller.

BRIEF DESCRIPTION OF THE DRAWINGS

Reference is made to the following description taken in connection with the accompanying drawings, like reference numerals being used for like corresponding parts in the various drawings.

DETAILED DESCRIPTION

It will be understood that the following embodiments are exemplary and thus matters specifying the claimed disclosure are not limited to specific structural and functional details disclosed herein.

The embodiments are applied to an electrophotographic monochrome image forming apparatus.

To facilitate understanding of the orientation and relationship of the various elements disclosed herein, the expressions "front", "rear", "top", "upper", "bottom", "lower", "right", and "left" are used to define the various parts when the image forming apparatus 1 is disposed in an orientation in which it is intended to be used.

For portions or components, which will be described with numerals, at least one is provided unless "plural" or "two or more" is specifically stated otherwise. Illustrative embodiments of the disclosure will be described with reference to the accompanying drawings.

A first embodiment will be described.

Figure 1:
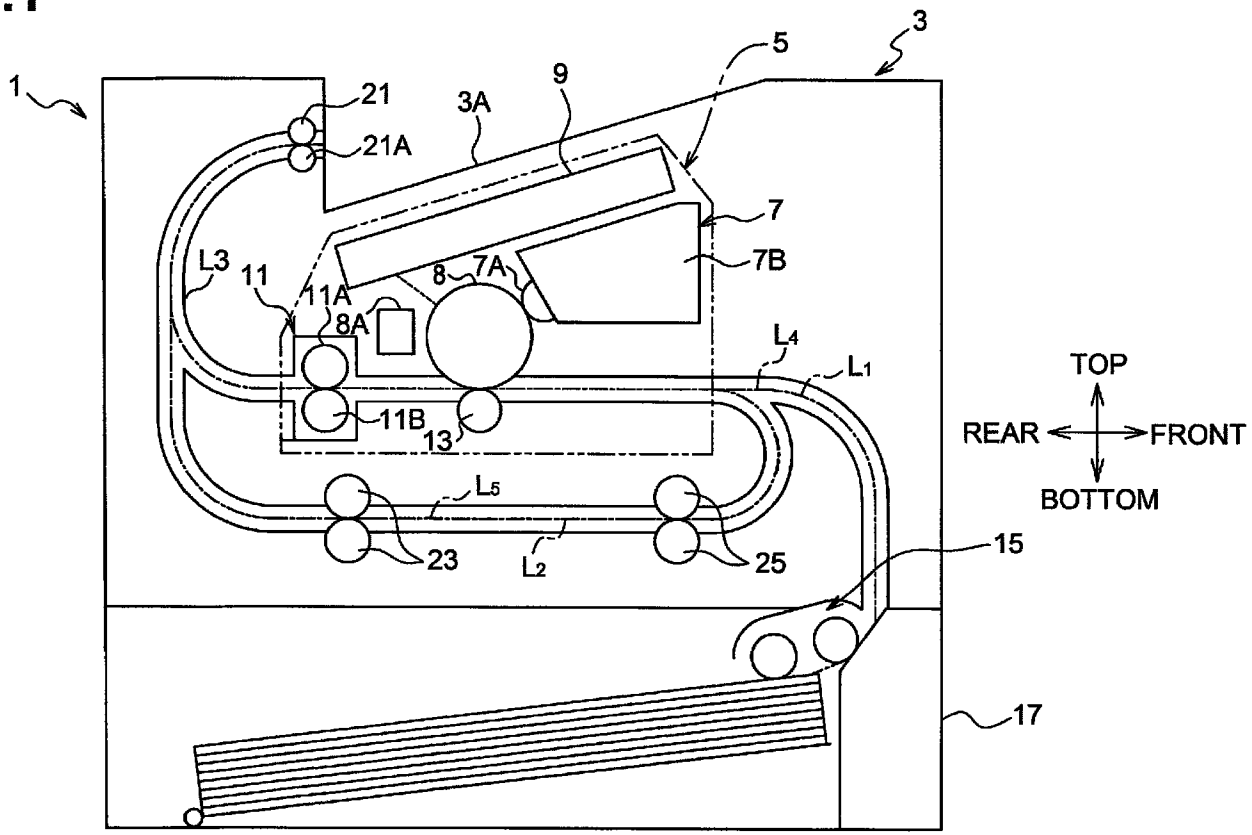
FIG. 1 is a schematic cross sectional view of an image forming apparatus according to an aspect of the disclosure.

As illustrated in FIG. 1, an image forming apparatus 1 includes an image forming unit 5 in a casing 3. The image forming unit 5 forms an image on a sheet. The image forming unit 5 includes a developing cartridge 7, a photosensitive drum 8, an exposure unit 9, and a fixing unit 11.

The developing cartridge 7 includes a developing roller 7A and a storing portion 7B. The photosensitive drum 8 carries a developer image to be transferred onto a sheet. A charger 8A charges the photosensitive drum 8. The exposure unit 9 exposes the charged photosensitive drum 8 to form an electrostatic latent image on the photosensitive drum 8.

The developing roller 7A supplies developer stored in the storing portion 7B to the photosensitive drum 8 to form a developer image on the photosensitive drum 8. A transfer roller 13 is disposed facing the photosensitive drum 8.

The transfer roller 13 transfers the developer image carried on the photosensitive drum 8 to a sheet. The fixing unit 11 is disposed downstream of the photosensitive drum 8 in a sheet feed direction to fix the developer image transferred onto the sheet. The fixing unit 11 includes a heat roller 11A and a pressure roller 11B.

The heat roller 11A applies heat to the developer image on the sheet directly or indirectly. The pressure roller 11B presses the sheet against the heat roller 11A. Hereinafter, the heat roller 11A and the pressure roller 11B are collectively referred to as fixing rollers 11A, 11B.

The fixing rollers 11A, 11B of the fixing unit 11 convey the sheet toward a sheet ejection tray 3A. The sheet ejection tray 3A receives the sheet having image thereon. A feeder 15 is disposed upstream of the image forming unit 5.

The feeder 15 feeds sheets received in a sheet supply tray 17, one by one, toward the image forming unit 5. The sheet supply tray 17 is detachably attached to the casing 3. The sheet supply tray 17 is detachable from the casing 3 for refilling the sheet supply tray 17 or replacing sheets with a different type of sheets.

Sheets in the sheet supply tray 17 are conveyed one by one along a sheet feed path L1 from the sheet supply tray 17 via the image forming unit 5 to the sheet ejection tray 3A. The sheet ejection tray 3A receives a sheet having an image formed thereon.

An ejection roller 21 is disposed downstream of the fixing unit 11 in the sheet feed direction. The ejection roller 21 is reversible. The ejection roller 21 rotates in a forward direction to eject a sheet toward the sheet ejection tray 3A. The ejection roller 21 rotates in a reverse direction, opposite to the forward direction, to convey a sheet having passed the fixing unit 11 back toward the photosensitive drum 8 again.

The image forming apparatus 1 of the embodiment performs printing by selecting a simplex printing mode or a duplex printing mode. The simplex printing mode allows printing of a sheet on a single side. The duplex printing mode allows printing of a sheet on both sides. Hereinafter, the ejection roller 21 is also referred to as a switchback roller 21. A pinch roller 21A is disposed facing the switchback roller 21. The pinch roller 21A presses a sheet against the switchback roller 21 and is driven by the sheet being fed to rotate.

When the switchback roller 21 rotates in the forward direction to eject a sheet toward the sheet ejection tray 3A, it is referred that the switchback roller 21 is in a forward rotation mode. When the switchback roller 21 rotates in the reverse direction to convey a sheet back toward the photosensitive drum 8 again, it is referred that the switchback roller 21 is in a reverse rotation mode.

In the duplex printing mode, after an image is formed on a first side of a sheet, the switchback roller 21 reverses the sheet feed direction to feed the sheet toward a re-feed path L2. The re-feed path L2 is a path starting from the switchback roller 21 toward the photosensitive drum 8.

The re-feed path L2 branches off from the sheet feed path L1 at a branch portion L3 downstream of the fixing unit 11 in the sheet feed direction, and is connected to the sheet feed path L1 at a junction portion L4 upstream of the photosensitive drum 8 in the sheet feed direction. The re-feed path L2 includes a sheet feed path L5 extending from the branch portion L3 to the junction portion L4. The sheet feed path L5 is spaced below the image forming unit 5 including the photosensitive drum 8.

A pair of first re-feeding rollers 23 and a pair of second re-feeding rollers 25 are disposed in the sheet feed path L5. The first re-feeding rollers 23 are disposed closer to the branch portion L3 in the sheet feed path L5 than the second re-feeding rollers 25 and configured to feed a sheet toward a downstream side of the sheet feed path L5.

The second re-feeding rollers 25 are disposed closer to the junction portion L4 in the sheet feed path L5 than the first re-feeding rollers 23 and configured to feed the sheet toward the photosensitive drum 8. In other words, the second re-feeding rollers 25 are disposed downstream of the first re-feeding rollers 23.

The switchback roller 21, the fixing rollers 11A, 11B, and the first re-feeding rollers 23 are arranged in this order in a direction from the switchback roller 21 toward the first re-feeding rollers 23.

In the embodiment, the switchback roller 21 is disposed above the fixing unit 11 in a vertical direction, and the first re-feeding rollers 23 are disposed below the fixing unit 11 in the vertical direction.

The image forming unit 5 including the fixing unit 11 and other units is disposed between a pair of frames 19A, 19B (FIG. 2) and assembled thereto. The frames 19A, 19B are reinforcing members made of resin or metal, and are covered by the casing 3.

Figure 2:
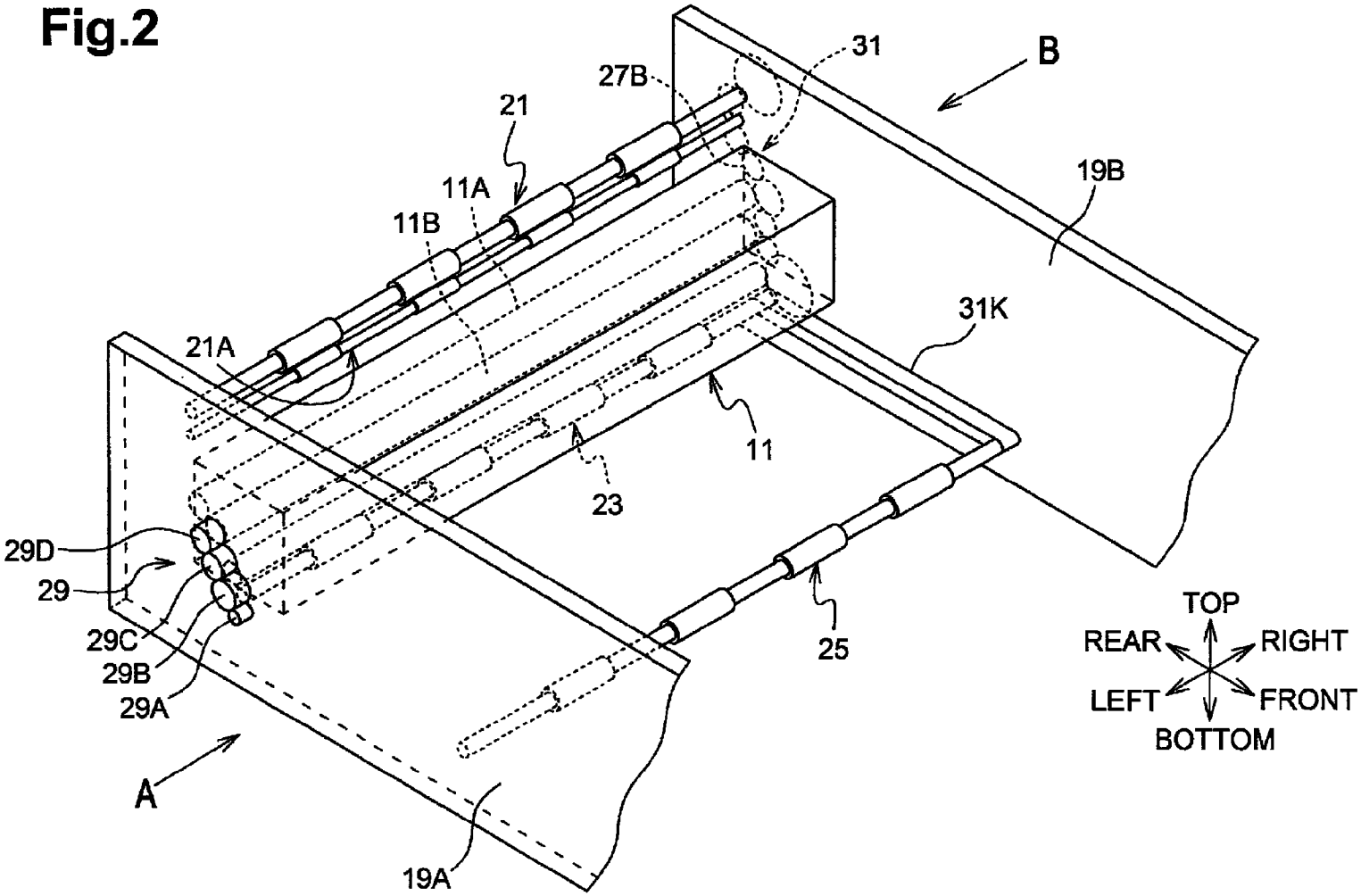
FIG. 2 is a perspective view of a pair of frames, a fixing unit, a switchback roller, and a re-feeding roller of the image forming apparatus.

As illustrated in FIG. 2, the frame 19A is disposed to one ends, e.g., left ends, of the fixing rollers 11A, 11B in their axial direction and is referred to as a first frame 19A, and the frame 19B is disposed to the other ends, e.g., right ends, of the fixing rollers 11A, 11B in their axial direction and is referred to as a second frame 19B.

Figure 3:
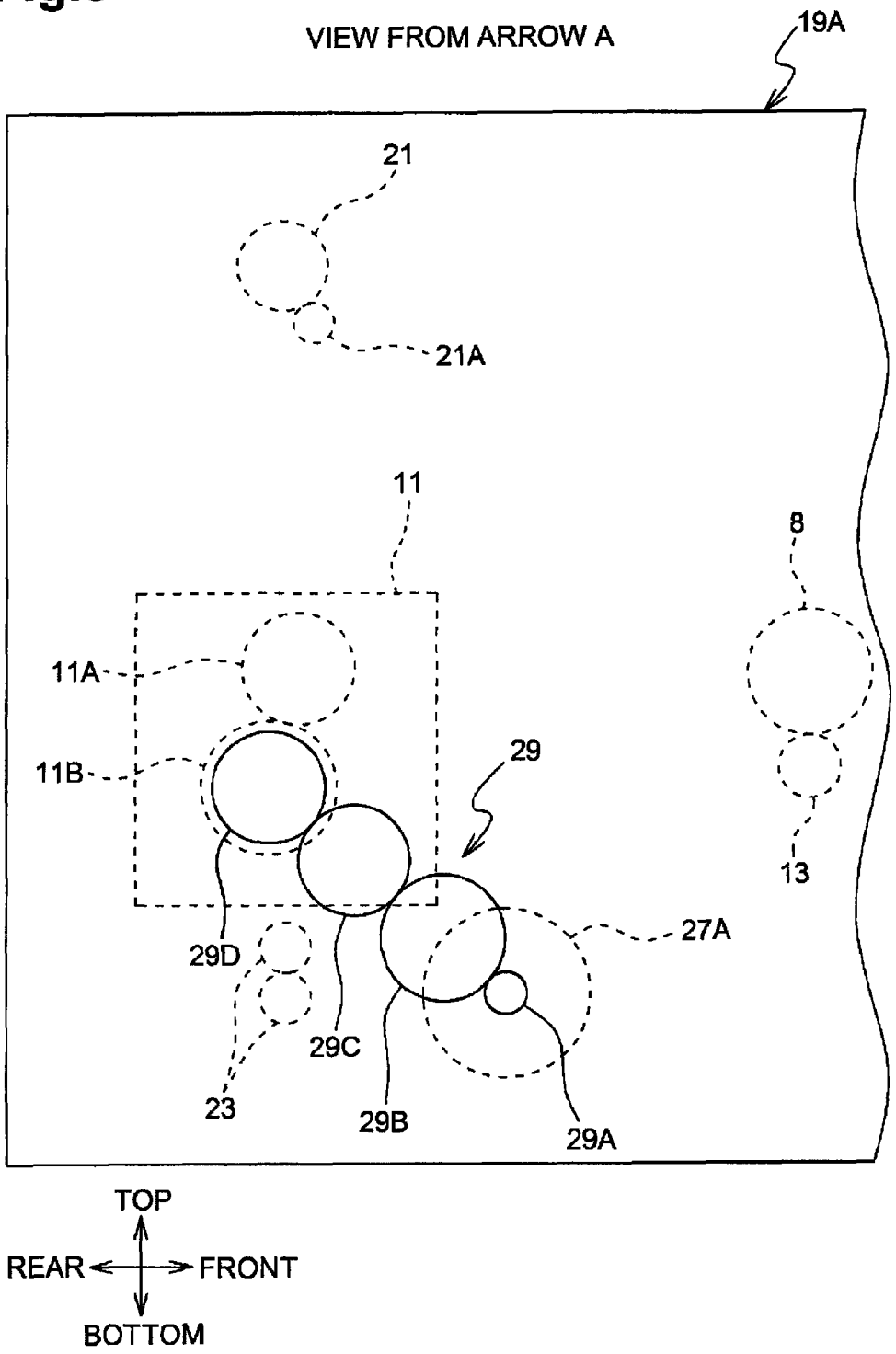
FIG. 3 is a partial view from arrow A of FIG. 2, illustrating a first transmission mechanism.
Figure 4:
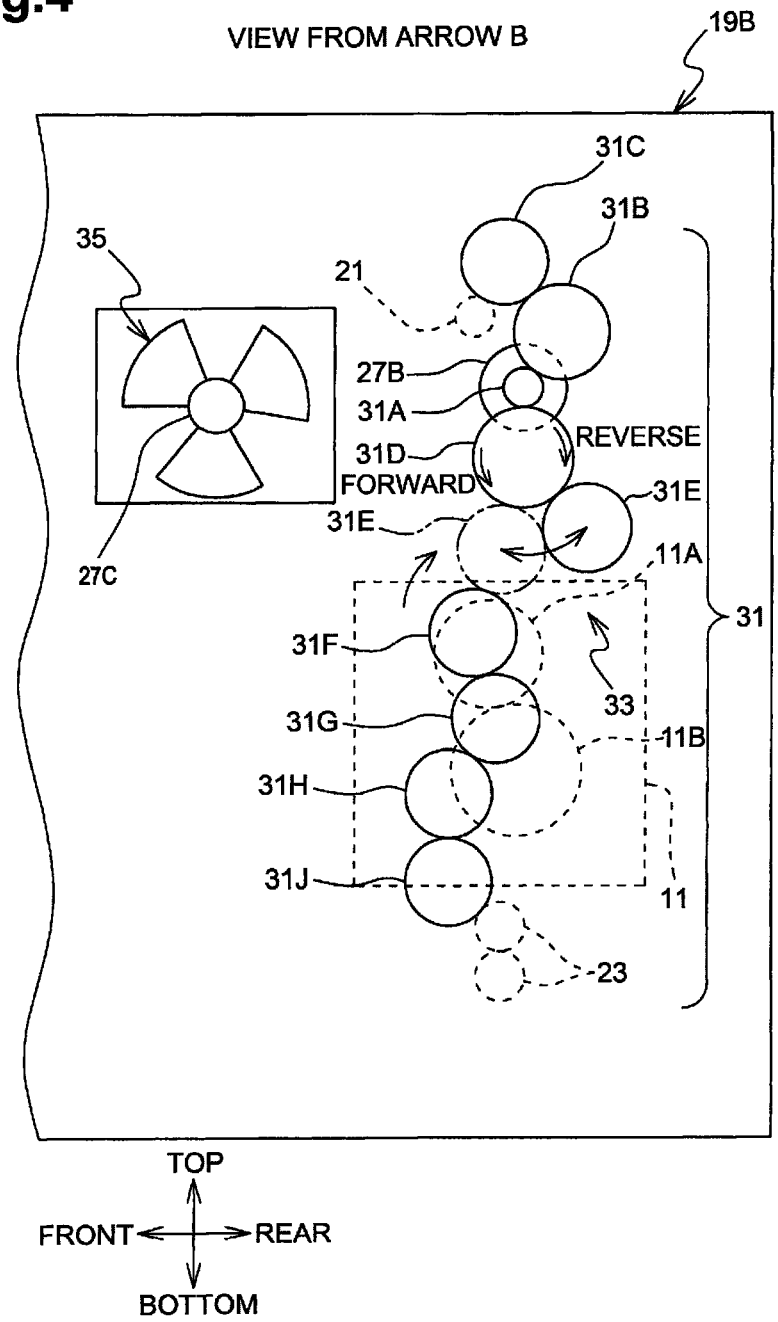
FIG. 4 is a partial view from arrow B of FIG. 2, illustrating a second transmission mechanism.

As illustrated in FIGS. 2, 3, and 4, a first motor 27A and a first transmission mechanism 29 are disposed to the first frame 19A. A second motor 27B and a second transmission mechanism 31 are disposed to the second frame 19B. In FIG. 2, the casing 3 is omitted. The casing 3 covers the frames 19A, 19B.

The first transmission mechanism 29 is disposed between the first frame 19A and the casing 3, and is assembled to the first frame 19A. In other words, the first transmission mechanism 29 is disposed on a side of the first frame 19A opposite to the fixing unit 11.

The second transmission mechanism 31 is disposed between the second frame 19B and the casing 3, and is fixed to the second frame 19B. In other words, the second transmission mechanism 31 is disposed on a side of the second frame 19B opposite to the fixing unit 11.

The first motor 27A is disposed on the same side of the first frame 19A as the fixing unit 11. The second motor 27B is disposed on the same side of the second frame 19B as the fixing unit 11.

As illustrated in FIG. 3, the first motor 27A supplies a drive force to the fixing rollers 11A, 11B. The first transmission mechanism 29 transmits a drive force produced in the first motor 27A to the fixing rollers 11A, 11B.

The first transmission mechanism 29 of the embodiment is a gear train including plural gears 29A-29D. The gear 29A is assembled to an output shaft of the first motor 27A.

The gears 29B, 29C receive a drive force from the gear 29A and transmit the drive force to the gear 29D. The first transmission mechanism 29 illustrated in FIG. 3 is an example of a gear train of the embodiment, and thus FIG. 3 does not show the exact number of gears.

The first motor 27A supplies a drive force to the photosensitive drum 8 and the transfer roller 13 in addition to the fixing rollers 11A, 11B. The drive force is transmitted to the photosensitive drum 8 via a drive force transmission mechanism (not shown) including plural gears.

As illustrated in FIG. 4, the second motor 27B supplies a drive force to the switchback roller 21 and is a drive roller of the first re-feeding rollers 23 (hereinafter, a singular form of the first re-feeding rollers 23 means a drive roller of the first re-feeding rollers 23). The second transmission mechanism 31 transmits a drive force produced in the second motor 27B to the switchback roller 21 and the first re-feeding roller 23.

The second transmission mechanism 31 of the embodiment is a gear train including plural gears 31A, 31B, 31C, 31D, 31E, 31F, 31G, 31H, and 31J. The gear 31A is assembled to an output shaft of the second motor 27B. The gear 31B receives a drive force from the gear 31A and transmits the drive force to the gear 31C adjacent to the switchback roller 21. The gears 31A, 31B, and 31C constitute a drive force transmission path for transmitting the drive force to the switchback roller 21.

The gears 31D, 31E, 31F, 31G, 31H, and 31J receive a drive force from the gear 31A, and transmit the drive force to the first re-feeding roller 23. The gears 31A, 31D, 31E, 31F, 31G, 31H, and 31J constitute a drive force transmission path for transmitting the drive force to the first re-feeding roller 23. The second transmission mechanism 31 illustrated in FIG. 4 is an example of a gear train of the embodiment and FIG. 4 does not show the exact number of gears.

In the second transmission mechanism 31 of the embodiment, the number of gears constituting a drive force transmission path from the second motor 27B to the switchback roller 21 is less than the number of gears constituting a drive force transmission path from the second motor 27B to the first re-feeding roller 23.

The drive force transmitted to the first re-feeding rollers 23 is transmitted to the second re-feeding rollers 25 via a toothed belt 31K (FIG. 2). The belt 31K is disposed to the second frame 19B or on the same side as the second transmission mechanism 31.

As illustrated in FIG. 4, a third motor 27C for driving a fan 35 is disposed to the second frame 19B. The fan 35 produces airflow for providing ventilation in the casing 3. The fan 35 of the embodiment produces airflow for exhausting air from the casing 3.

The first motor 27A is disposed adjacent to the photosensitive drum 8 further than the second motor 27B is, because the first motor 27A directly supplies a drive force to rollers relating to image formation such at the photosensitive drum 8 and the fixing rollers 11A, 11B.

When projected on an imaginary plane orthogonal to the axial direction of each of the fixing rollers 11A, 11B, or when viewed in the axial direction of the fixing rollers 11A, 11B, the second transmission mechanism 31 partially overlaps the fixing unit 11.

Further, the second transmission mechanism 31 projected on the imaginary plane partially overlaps the first transmission mechanism 29 projected on the imaginary plane.

The imaginary plane corresponds to a sheet surface of each of FIGS. 3 and 4. In FIG. 4, a part of the second transmission mechanism 31 overlaps the fixing unit 11 illustrated by a broken line. In FIG. 3, a part of the first transmission mechanism 29 overlaps the fixing unit 11 illustrated by a broken line. Thus, the second transmission mechanism 31 projected on the imaginary plane partially overlaps the first transmission mechanism 29 projected on the imaginary plane.

A clutch mechanism 33 is disposed in the drive force transmission path defined by the gears 31D-31G. The clutch mechanism 33 intermittently transmits a drive force to the first re-feeding roller 23.

Specifically, the clutch mechanism 33 interrupt transmission of a drive force to the first re-feeding roller 23 when the second motor 27B rotates in a forward direction, and transmits a drive force to the first re-feeding roller 23 when the second motor 27B rotates in a reverse direction.

When the second motor 27B rotates in the forward direction, the switchback roller 21 is in the forward rotation mode. When the second motor 27B rotates in the reverse direction, the switchback roller 21 is in the reverse rotation mode.

When the switchback roller 21 is in the forward rotation mode, the clutch mechanism 33 interrupts the transmission of a drive force to the first re-feeding roller 23, the first re-feeding rollers 23 and the second re-feeding rollers 25 stop. When the switchback roller 21 is in the reverse rotation mode, the clutch mechanism 33 transmits a drive force to the first re-feeding roller 23, the first re-feeding roller 23 and the second re-feeding rollers 25 rotate such that the sheet can be re-fed toward the photosensitive drum 8.

The clutch mechanism 33 of the embodiment includes the gear 31D-31E. A drive force of the second motor 27B is input to the gear 31D. Hereinafter, the gear 31D is referred to as an input gear 31D.

The gear 31F outputs the drive force to the re-feeding roller 2. Hereinafter, the gear 31F is referred to as an output gear 31F. The gear 31E transmits a drive force from the input gear 31D to the output gear 31F. Hereinafter, the gear 31E is referred to as a transmission gear 31E.

The transmission gear 31E is pivotable about a rotation center of the input gear 31D between a position (indicated by a chain double-dashed line) at which the transmission gear 31E engages with the input gear 31D and the output gear 31F and a position (indicated by a solid line) at which the transmission gear 31E is disengaged from the output gear 31F.

When the second motor 27B rotates in the forward direction, the pressure of engagement between the transmission gear 31E and the input gear 31D acts on the transmission gear 31E as a force to separate the transmission gear 31E from the output gear 31F. Thus, when the second motor 27B rotates in the forward direction, the transmission gear 31E is separated from the output gear 31F, resulting in interruption of transmission of a drive force to the first re-feeding roller 23.

When the second motor 27B rotates in the reverse direction, the pressure of engagement acts on the transmission gear 31E as a force to move the transmission gear 31E toward the output gear 31F. Thus, when the second motor 27B rotates in the reverse direction, the transmission gear 31E engages with the output gear 31F.

While the transmission gear 31E engages with the output gear 31F, the output gear 31F restricts the pivoting movement of the transmission gear 31E. Thus, the transmission gear 31E rotates by the pressure of the engagement without further pivoting, and transmits a drive force to the output gear 31F.

In the embodiment, the first transmission mechanism 29 for transmitting a drive force to the fixing unit 11 and the second transmission mechanism 31 for transmitting a drive force to the switchback roller 21 are disposed over the fixing rollers 11A, 11B. Namely, the embodiment obviates the need for a structure for preventing an overlap between the first transmission mechanism 29 and the second transmission mechanism 31.

The first transmission mechanism 29 and the second transmission mechanism 31 have a simple structure as compared with a case where the first transmission mechanism 29 and the second transmission mechanism 31 are disposed to only one end in the axial direction, and thus the image forming apparatus 1 is compact in size.

In the embodiment, the clutch mechanism 33 interrupts the transmission of a drive force to the first re-feeding roller 23 when the second motor 27B rotates in the forward direction, and transmits a drive force to the first re-feeding roller 23 when the second motor 27B rotates in the reverse direction.

Thus, while the second motor 27B rotates in the forward direction to feed a sheet toward the sheet ejection tray 3A, the re-feeding rollers such as the first re-feeding rollers 23 and the second re-feeding rollers 25, and gears for transmitting a drive force to the re-feeding rollers are stopped. This structure helps feed sheets to the sheet ejection tray 3A quietly.

The clutch mechanism 33 of the embodiment is configured to intermittently transmit a drive force to the first re-feeding roller 23 by pivotally moving the transmission gear 31E between the position where the transmission gear 31E engages with the input gear 31D and the output gear 31F and the position where the transmission gear 31E is disengaged from the output gear 31F.

Thus, a drive force to the first re-feeding roller 23 is intermittently transmitted by switching the rotation direction of the second motor 27B between the forward direction and the reverse direction. This configuration enables intermittent transmission of a drive force to the first re-feeding rollers 23 with an inexpensive structure compared to a case where the clutch mechanism 33 is a solenoid clutch.

In the embodiment, the number of gears constituting a path for transmitting a drive force from the second motor 27B to the switchback roller 21 is less than the number of gears constituting a path for transmitting a drive force from the second motor 27B to the first re-feeding roller 23.

In other words, the number of gears that rotate to feed sheets toward the sheet ejection tray 3A is less than the number of gears that rotate to re-feed sheets toward the photosensitive drum 8.

Noise during feeding of sheets can be reduced further with a fewer number of gears. The number of times at which the switchback roller 21 enters the forward rotation mode is greater than the number of times at which the switchback roller 21 enters the reverse rotation mode. This structure effectively reduces the occurrence of noise in the image forming apparatus 1.

In the embodiment, a part of the second transmission mechanism 31 projected on the imaginary plane orthogonal to the axial direction of each of the fixing rollers 11A, 11B overlaps the fixing unit 11 projected on the imaginary plane. This arrangement provides the drive force transmission path defined by the second transmission mechanism 31 substantially straightly (FIG. 4) without the need to greatly bend the path. Thus, the structure of the second transmission mechanism 31 is simple.

In the embodiment, a part of the second transmission mechanism 31 projected on the imaginary plane orthogonal to the axial direction of each of the fixing rollers 11A, 11B overlaps the first transmission mechanism 29 projected on the imaginary plane. This arrangement provides the drive force transmission path constituted by the second transmission mechanism 31 substantially straightly as with the case of the drive force transmission path constituted by the first transmission mechanism 29. Thus, the second transmission mechanism 31 is realized with a simple structure.

In the embodiment, the first motor 27A is disposed adjacent to the photosensitive drum 8 further than the second motor 27B is. This reduces the length of the drive force transmission path from the first motor 27A to the photosensitive drum 8, which obviates the need to increase the number of gears. This enables an angle of rotation for the photosensitive drum 8 to be controlled precisely.

As the second motor 27B supplies a drive force to the switchback roller 21 and the first re-feeding roller 23, a motor having an outer diameter smaller than the outer diameter of the first motor 27A can be used. Thus, the image forming apparatus 1 is compact in size as the third motor 27C for driving the fan 35 is disposed to the second frame 19B.

The above embodiment shows but is not limited to that the clutch mechanism 33 includes the transmission gear 31E that is pivotable. The clutch mechanism 33 may include a solenoid clutch.

The above embodiment shows but is not limited to that the second transmission mechanism 31 includes the clutch mechanism 33. The clutch mechanism 33 may be omitted. In a case where the clutch mechanism 33 is omitted, the first re-feeding roller 23 may rotate together with the switchback roller 21.

The above embodiment shows but is not limited to that the number of gears constituting the drive force transmission path from the second motor 27B to the switchback roller 21 is less than the number of gears constituting the drive force transmission path from the second motor 27B to the first re-feeding roller 23.

The above embodiment shows but is not limited to that a part of the second transmission mechanism 31 projected on the imaginary plane orthogonal to the axial direction of each of the fixing rollers 11A, 11B overlaps the fixing unit 11 projected on the imaginary plane.

The above embodiment shows but is not limited to that a part of the second transmission mechanism 31 projected on the imaginary plane orthogonal to the axial direction of each of the fixing rollers 11A, 11B overlaps the first transmission mechanism 29 projected on the imaginary plane.

The above embodiment shows but is not limited to that the first motor 27A is disposed adjacent to the photosensitive drum 8 further than the second motor 27B is. For example, the second motor 27B may be disposed adjacent to the photosensitive drum 8 further than the first motor 27A may be.

The above embodiment shows but is not limited to that the third motor 27C for driving the fan 35 is disposed to the second frame 19B. For example, the third motor 27C may be disposed to the first frame 19A.

The above embodiment shows but is not limited to that the fan 35 is an exhaust fan. The fan 35 may be an intake fan that blows air into the casing 3.

The above embodiment shows but is not limited to that the switchback roller 21, the fixing rollers 11A, 11B, and the first re-feeding roller 23 are arranged in this order in the direction from the switchback roller 21 toward the first re-feeding roller 23.

The above embodiment shows but is not limited to that the first transmission mechanism 29 and the second transmission mechanism 31 are gear trains composed of plural gears.

The first transmission mechanism 29 and the second transmission mechanism 31 may use a toothed belt or transmission shaft instead of gears.

The first transmission mechanism 29 and the second transmission mechanism 31 of the above embodiment are disposed between the casing 3 and each of the frames 19A, 19B.

For example, (a) the first transmission mechanism 29 and the second transmission mechanism 31 may be disposed to the fixing unit 11 relative to the frames 19A, 19B. Alternatively, (b) some of gears constituting the first transmission mechanism 29 and the second transmission mechanism 31 may be disposed the casing 3 and each of the frames 19A, 19B, and other some of the gears may be disposed to the fixing unit 11 relative to the frames 19A, 19B.

The above embodiment shows but is not limited to that the disclosure is applied to a monochrome electrophotographic image forming apparatus. The disclosure is applicable to a color image forming apparatus.

What is claimed is:

1. An electrophotographic image forming apparatus configured to form images on both sides of a sheet, comprising:

a photosensitive drum configured to carry a developer image to be transferred to the sheet;

a fixing unit disposed downstream of the photosensitive drum and configured to fix the developer image on the sheet, the fixing unit including a fixing roller;

a sheet ejection tray configured to receive the sheet having the image fixed by the fixing unit;

a switchback roller configured to rotate in a forward direction to convey the sheet ejected from the fixing unit to the sheet ejection tray in a forward rotation mode and to rotate in a reverse direction to convey the sheet ejected from the fixing unit back toward the photosensitive drum again in a reverse rotation mode;

a re-feeding roller configured to re-feed the sheet fed by the switchback roller toward the photosensitive drum;

a first frame disposed to a first end of the fixing roller in an axial direction of the fixing roller;

a second frame disposed to a second end, opposite to the first end, of the fixing roller in the axial direction;

a first motor disposed to the first frame and configured to generate a drive force;

a first transmission mechanism disposed to the first frame and configured to transmit the drive force generated in the first motor to the fixing roller;

a second motor disposed to the second frame and configured to generate a drive force; and a second transmission mechanism disposed to the second frame and configured to transmit the drive force generated in the second motor to the switchback roller and the re-feeding roller, wherein the second motor is configured to rotate in a forward rotation direction such that the switchback roller enters the forward rotation mode, and to rotate in a reverse rotation direction such that the switchback roller enters the reverse rotation mode, wherein the second transmission mechanism includes a clutch mechanism configured to intermittently transmit the drive force generated in the second motor to the re-feeding roller, and wherein the clutch mechanism is configured to:

when the second motor rotates in the forward rotation direction, interrupt transmission of the drive force generated in the second motor; and when the second motor rotates in the reverse rotation direction, transmit the drive force generated in the second motor to the re-feeding roller.

2. The image forming apparatus according to claim 1, wherein the clutch mechanism includes:

an input gear configured to receive a drive force from the second motor;

an output gear configured to output the drive force toward the re-feeding roller; and a transmission gear configured to transmit the drive gear from the input gear to the output gear, the transmission gear being configured to pivot about a rotation center of the input gear between a position at which the transmission gear engages with the input gear and the output gear and a position at which the transmission gear is disengaged from the output gear.

3. The image forming apparatus according to claim 1, wherein the second transmission mechanism includes a first path for transmitting the drive force generated in the second motor to the switchback roller and a second path for transmitting the drive force generated in the second motor to the re-feeding roller, and wherein the number of gears for the first path is less than the number of gears for the second path.

4. The image forming apparatus according to claim 1, wherein, when viewed in the axial direction of the fixing roller, the second transmission mechanism partially overlaps the fixing unit.

5. The image forming apparatus according to claim 1, wherein, when viewed in the axial direction of the fixing roller, the second transmission mechanism partially overlaps the first transmission mechanism.

6. The image forming apparatus according to claim 1, wherein the first motor generates a drive force to be transmitted to the fixing roller and the photosensitive drum, and wherein the first motor is disposed closer to the photosensitive drum than the second motor is.

7. The image forming apparatus according to claim 1, further comprising:

a ventilation fan; and a third motor configured to generate a drive force to drive the fan, wherein the third motor is disposed to the second frame.

8. The image forming apparatus according to claim 1, wherein the switchback roller, the fixing roller, and the re-feeding roller are disposed in this order in a direction from the switchback roller to the re-feeding roller.

9. The image forming apparatus according to claim 1, wherein the switchback roller is disposed above the fixing unit, and wherein the re-feeding roller is disposed below the fixing unit.

* * * * *